US009441397B2

(12) United States Patent
Clifford et al.

(10) Patent No.: US 9,441,397 B2
(45) Date of Patent: Sep. 13, 2016

(54) END CAPS FOR LOCK CYLINDERS

(71) Applicant: Schlage Lock Company, LLC, Carmel, IN (US)

(72) Inventors: Jason C. Clifford, Colorado Springs, CO (US); Skyler K. Biek, Colorado Springs, CO (US); Kenneth M. Curtis, Colorado Springs, CO (US); Dale B. Shillington, II, Colorado Springs, CO (US); David K. Matteucci, Colorado Springs, CO (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 14/273,731

(22) Filed: May 9, 2014

(65) Prior Publication Data

US 2014/0331725 A1 Nov. 13, 2014

Related U.S. Application Data

(60) Provisional application No. 61/821,925, filed on May 10, 2013.

(51) Int. Cl.

| | |
|---|---|
| ***E05B 9/10*** | (2006.01) |
| ***E05B 27/00*** | (2006.01) |
| ***E05B 17/04*** | (2006.01) |
| *E05B 9/08* | (2006.01) |
| *E05B 15/00* | (2006.01) |

(52) U.S. Cl.

CPC ..... *E05B 27/0003* (2013.01); *E05B 17/04* (2013.01); *E05B 9/084* (2013.01); *E05B 9/086* (2013.01); *E05B 15/0013* (2013.01); *Y10T 29/49902* (2015.01); *Y10T 70/8486* (2015.04)

(58) Field of Classification Search

CPC ..... E05B 9/04; E05B 9/08; E05B 9/084; E05B 9/086; E05B 15/0013; E05B 27/00

USPC ..... 70/336, 357, 367, 370–373, 375, 379 R, 70/380, 381, 449

See application file for complete search history.

(56) References Cited

U.S. PATENT DOCUMENTS

| | | | | |
|---|---|---|---|---|
| 2,042,025 | A * | 5/1936 | Schlage | 70/379 R |
| 2,261,218 | A | 11/1941 | Bluemle | |
| 2,977,786 | A | 4/1961 | Kendrick et al. | |
| 4,369,642 | A * | 1/1983 | Grell | 70/389 |
| 4,586,354 | A * | 5/1986 | Smith | 70/451 |
| 4,966,021 | A | 10/1990 | Boag | |

(Continued)

OTHER PUBLICATIONS

International Search Report, PCT/US2014/037678, Sep. 9, 2014, 2 pages.

(Continued)

*Primary Examiner* — Suzanne Barrett
*Assistant Examiner* — Morgan McClure
(74) *Attorney, Agent, or Firm* — Taft Stettinius & Hollister LLP

(57) ABSTRACT

Systems, methods and devices relating to lock assemblies for doors are disclosed. The lock assemblies include an end cap that couples a tail piece, cam or other latch operating mechanism to the plug of the lock assembly so that the latch operating mechanism rotates with rotation of the plug to operate a latch. The end cap includes a plug engaging portion that is configured to interfit with an end cap receiving portion of the plug to axially and rotatably fix the end cap to the plug.

20 Claims, 4 Drawing Sheets

(56) References Cited

U.S. PATENT DOCUMENTS

| | | | | |
|---|---|---|---|---|
| 5,121,618 | A * | 6/1992 | Scott | 70/367 |
| 5,226,304 | A * | 7/1993 | Scott | 70/369 |
| 7,003,994 | B2 | 2/2006 | Ruan | |
| 7,222,508 | B2 | 5/2007 | Dickhans et al. | |
| 8,316,676 | B2 | 11/2012 | Chiang et al. | |
| 8,336,349 | B2 * | 12/2012 | Thimmappa et al. | 70/371 |
| 2003/0127864 | A1 | 7/2003 | Dalsing | |
| 2004/0020251 | A1 * | 2/2004 | Ramsauer | 70/208 |
| 2005/0011239 | A1 * | 1/2005 | Lurie et al. | 70/369 |

OTHER PUBLICATIONS

Written Opinion of the International Searching Authority, PCT/US2014/037678, Sep. 9, 2014, 4 pages.

* cited by examiner

END CAPS FOR LOCK CYLINDERS

CROSS-REFERENCE TO RELATED APPLICATION

The present application claims the benefit of the filing date of Provisional Application No. 61/821,925 filed on May 10, 2013, which is incorporated herein by reference.

FIELD OF THE INVENTION

The invention relates to a lock assemblies for a door. More particularly, the invention relates to lock cylinders with end caps for securing a latch operating mechanism to the lock assembly.

BACKGROUND

Some lock assemblies include a housing and a plug that define respective pin chambers to receive pin pairs that respond to a key inserted in a keyway of the plug. When the correct key is inserted, the plug is rotatable relative to the housing to an unlocked position. The plug rotates an latch operating mechanism that is attached to the end of the plug with an end cap.

Some existing lock assemblies include end caps in the form of a mortise cam that is attached to the plug so that the plug moves the mortise cam between a locked position and an unlocked position to operate a latch. In some lock cylinders the mortise cam is attached to the lock cylinder using a screw. Other lock assemblies use end caps in the form of a cylinder that is attached to the plug to rotatably couple a driver bar to the plug. The driver bar extends from the plug to operate a latch to lock and unlock the door. Typically, the end cap is attached to the plug using a threaded connection between the cylinder and the plug. The plug further includes a spring-biased alignment pin that secures the end cap in a fixed rotational position relative to the plug so that the mortise cam or cylinder is fixed to the plug to rotate with the plug.

Since lock cylinder plugs are typically designed to support both types of end cap attachments, cylinder plug geometries are complicated and difficult to manufacture. In addition, the attachment features on the plug introduce weaknesses that can cause failure. Increased manufacturing time to assemble the end cap with the plug is also caused by the complicated and intricate interfaces created by the screwed and threaded connections. Therefore, additional improvements in the attachment of end caps to lock assemblies is needed.

SUMMARY

There is disclosed herein systems, methods and devices relating to lock assemblies for doors. The lock assemblies include an end cap that couples a tail piece, cam or other latch operating mechanism to the plug of the lock assembly so that the latch operating mechanism rotates with rotation of the plug to operate a latch. The end caps include a plug engaging portion that is configured to slidably engage an end cap receiving portion of the plug. In certain forms, the plug engaging portion provides opposite projecting members that are received in respective undercut portions of the plug defined by the end cap receiving portion. The end cap receiving portion include linear wall segments along the undercut portion to provide a keyed relationship between the end cap and the plug. The keyed, interfitted engagement relationship between the end cap and the plug rotatably and axially fixes the end cap to the plug. An alignment pin can extend from the plug and engage the end cap to laterally secure the end cap to the plug.

In addition, methods for assembling the lock assembly discussed above are disclosed. These and other forms, features, embodiments, aspects, advantages, and objects are discussed further below.

DETAILED DESCRIPTION

Figure 1:
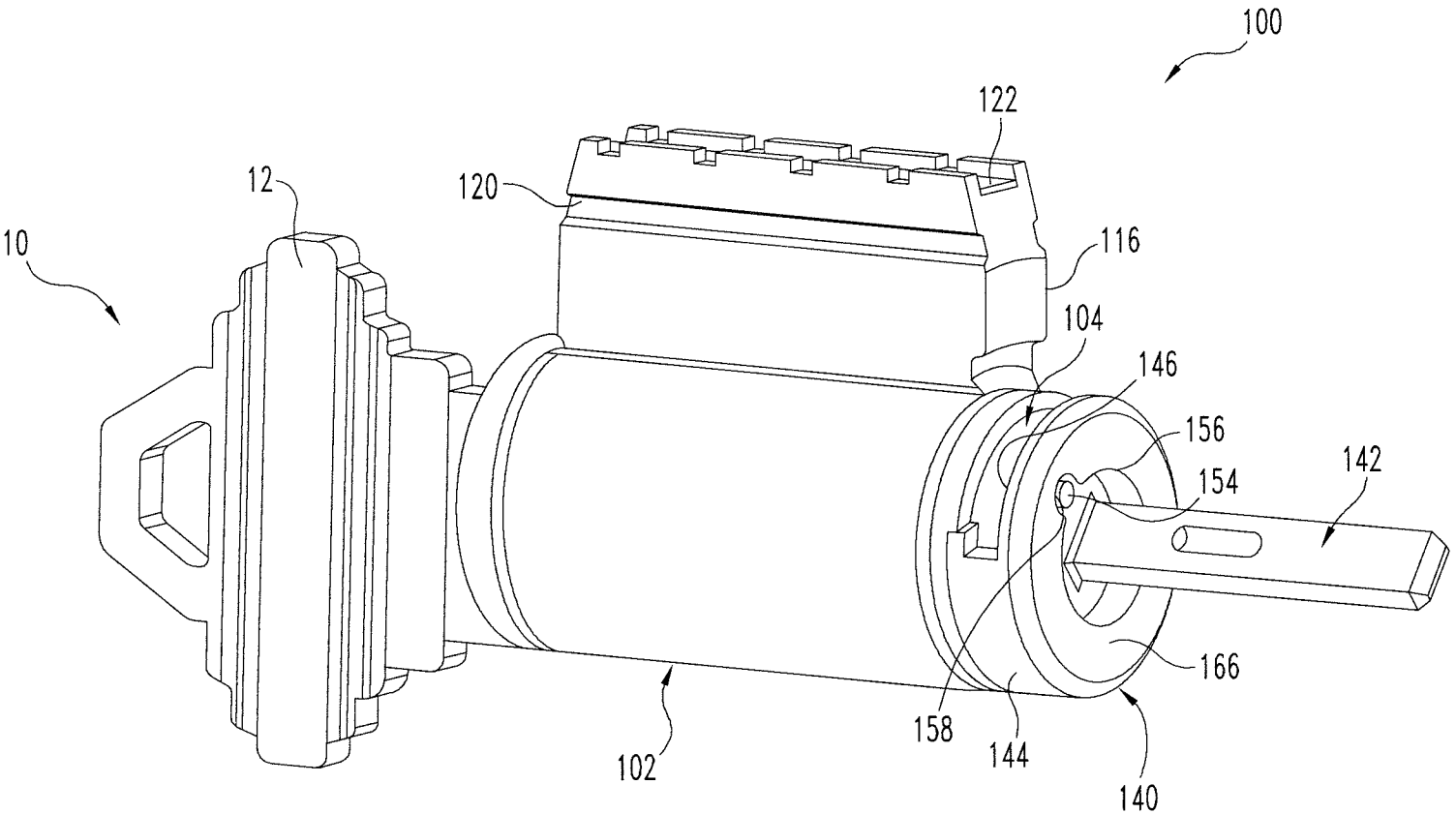
FIG. 1 is a perspective view of a lock assembly including a housing, a plug, an end cap, a latch operating mechanism and an appropriate key.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
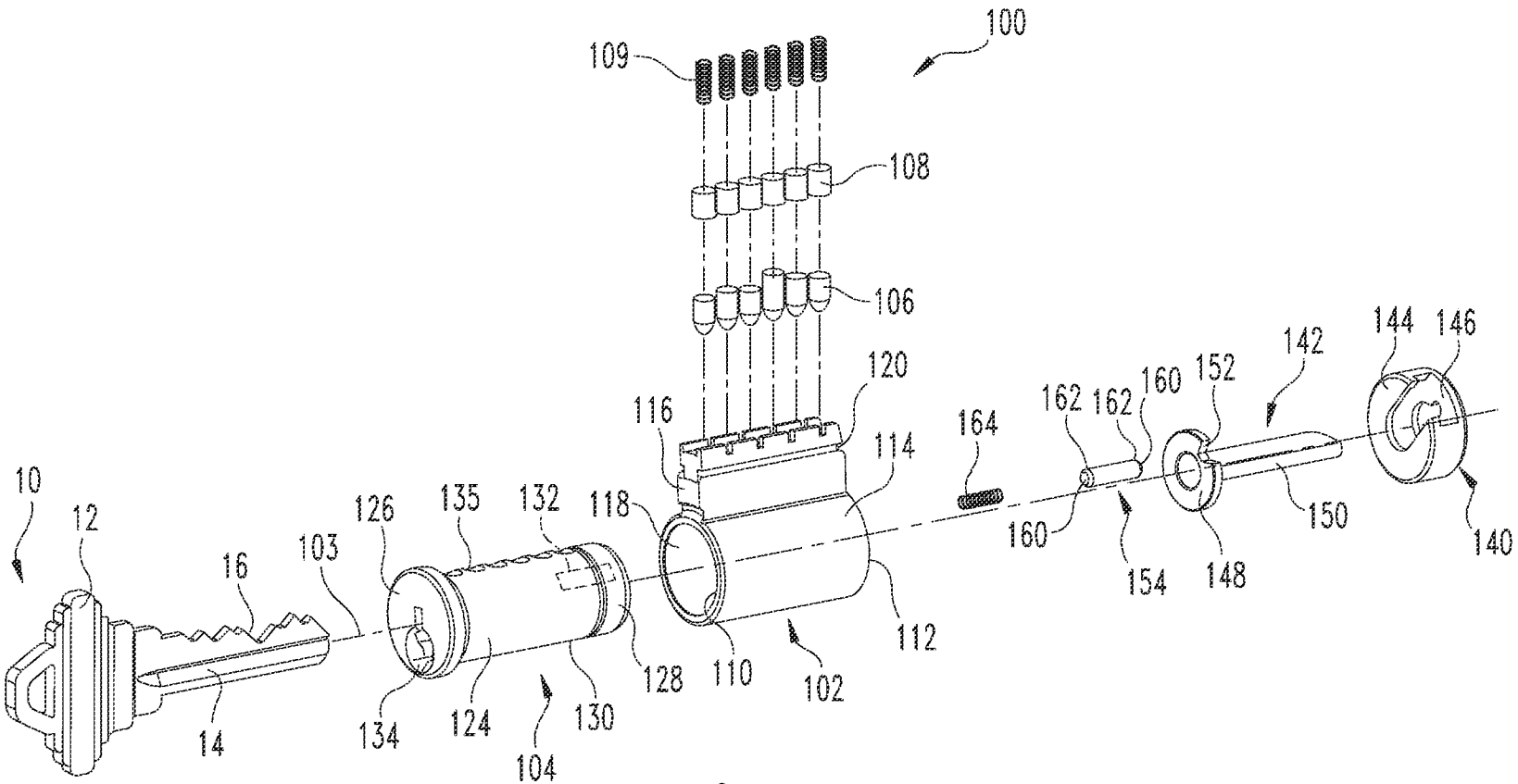
FIG. 2 is an exploded perspective view of the lock assembly of FIG. 1.
Figure 3:
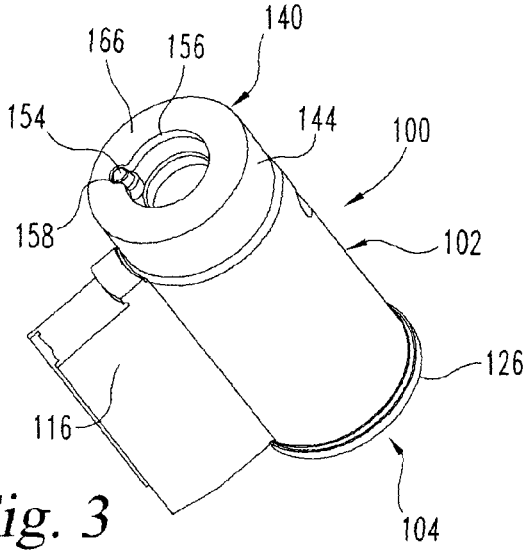
FIG. 3 is a perspective view looking toward the end cap of the lock assembly of FIG. 1.
Figure 4:
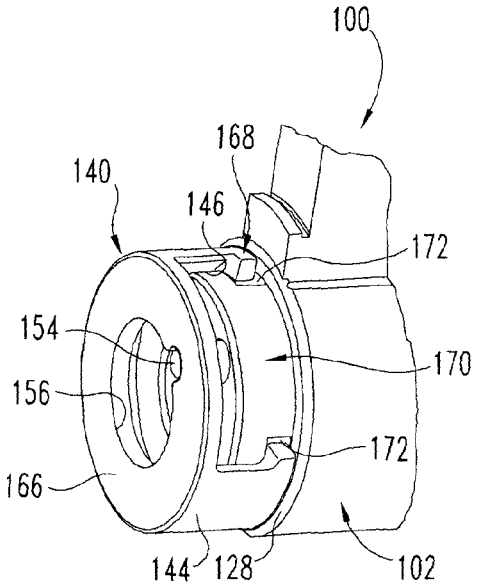
FIG. 4 is another perspective view of the end cap assembled to the lock assembly of FIG. 1.
Figure 5:
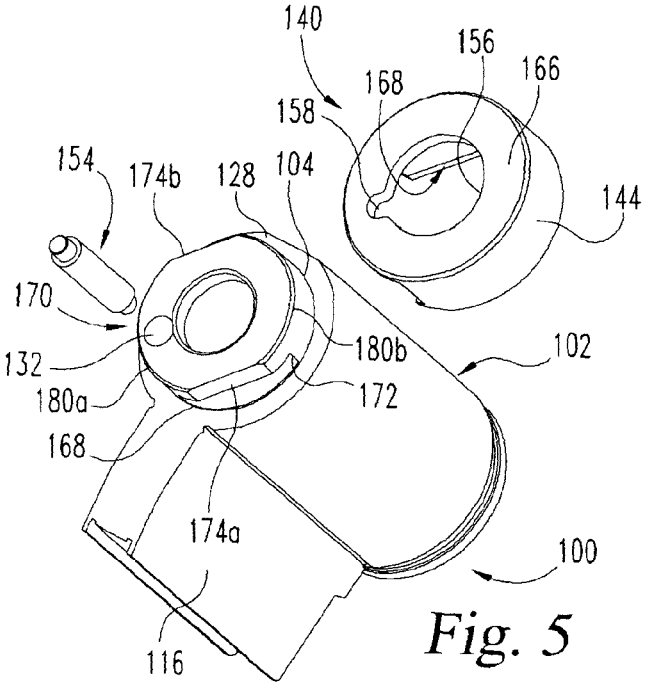
FIG. 5 is an exploded perspective view looking of a portion of the lock assembly of FIG. 1 showing the end cap spaced from the plug.

FIGS. 1-2 show a lock assembly 100 for use with an access structure such as a door, access panel, portable locks, or other structure that may be locked and unlocked. As used herein, the term "door" is used to represent all lockable structures and is not limited ingress and egress devices for buildings. The lock assembly 100 is a key-in-knob lock assembly that is lockable and unlockable using an appropriate key 10. Key 10 includes a head portion 12 and a blade 14 extending from head portion 12 that is received in lock assembly 100. As known in the art, the blade 14 is shaped or cut to include pin engaging portions 16 that are formed along the length of the blade 14 to engage movable inner pins 106 in lock assembly 100.

Lock assembly 100 includes a housing 102 and a plug 104 extending along and defining a longitudinal axis 103. Plug 104 is selectively rotatable within the housing 102 using the appropriate key 10 so that plug 104 moves about a rotation axis that is defined by or parallel to longitudinal axis 103. As known in the art, the housing 102 and the plug 104 cooperate with each other to define a shear line along which inner pins 106 and outer pins 108 are aligned to unlock lock assembly 100.

Housing 102 includes a first end 110, an opposite second end 112, a wall 114 extending between ends 110, 112, and a pin portion 116 that projects outwardly from one side of wall 114. The wall 114 is substantially cylindrical and defines a hollow portion 118 that receives the plug 104. The housing 102 is typically fixed relative to the door, and the plug 104 is rotatable relative to the housing 102 within the hollow portion 118 for movement between a locked position and an unlocked position.

The pin portion 116 projects outwardly from wall 114 and includes insertion slots 120 and a cover 122. Pin portion 116 defines a plurality of chambers that at least partially house outer pins 108 and springs 109 in chambers that are closed by cover 122. Inner pins 106 are housed at least partially in chambers of plug 104.

Plug 104 includes a body 124 that is rotatable relative to the housing 102 within the hollow portion 118. The body 124 includes a first end portion 126, an opposite second end portion 128, and an outer surface 130. The first end portion 126 is accessible from the front of the lock assembly 100. The second end portion 128 is accessible from the rear of the lock assembly 100. FIG. 1 shows that the plug 104 includes at least one pin hole 132 that extends axially into the plug 104 from the second end portion 128. The plug 104 also includes a key slot 134 that is in communication with the inner chambers 135 housing inner pins 106. The key slot 134 extends longitudinally through the body 124 from the first end portion 126 toward the second end portion 128, and is further accessible from adjacent the first end portion 126.

Outer pins 108 are configured to move in a first or inward direction into the plug 104, and in a second or outward direction away from the plug 104. Generally, the outer pins 108 extend partially into the respective inner pin chambers 135 when the plug 104 is in the locked position and the appropriate key 10 is not inserted into the key slot 134. The pin portion 116 further includes springs 109 to bias the outer pins 108 inwardly. In other constructions, the outer pins 108 may tend to move inward without the springs 109, such as by gravity. When blade 14 of key 10 is inserted, it contacts and moves inner pins 106 and outer pins 108 in contact with inner pins 106 to align the connection between pins 106 and 108 with the shear line. Thus, key 10 can rotate plug 104 in housing 102, and when key 10 is withdrawn one or more of pins 106, 108 extend across the shear line to prevent rotation of plug 104 in housing 102.

FIGS. 1-2 also show that the assembly 100 also includes a retainer or end cap 140 and a latch operating mechanism in the form of a driver bar or tail piece 142. The end cap 140 is attached to the second end portion 128 of the plug 104 to rotatably couple the tail piece 142 to the plug 104 so that a latch (not shown) can be moved relative to the door by tail piece 142 to lock or unlock the door. More particularly, the end cap 140 includes a cylindrical wall 144 defining a lateral opening 146 that is configured to allow end cap 140 to slidably fit on second end portion 128 of plug 104 from a lateral direction that is transverse to longitudinal axis 103.

The tail piece 142 is attached to the plug 104 via the end cap 140, and extends along longitudinal axis 103 into the door. The tail piece 142 includes a pin engagement portion 148 and a bar 150 extending from pin engagement portion 148. The pin engagement portion 148 includes at least one pin slot 152 that is generally aligned with the at least one of the pin hole 132 in plug 104 when the tail piece 142 is attached to the plug 104. The bar 150 extends longitudinally from the pin engagement portion 148, and engages the driver mechanism to move the latch between the locked position and the unlocked position.

An alignment pin 154 is disposed in pin hole 132 to laterally secure the plug 104 and the tail piece 142 when plug 104 is positioned on second end portion 128 in its proper position. The alignment pin 154 is an elongated member that includes opposite tapered or reduced-diameter ends 160 that define oppositely facing shoulders 162 of the alignment pin 154. A spring 164 is disposed in the pin hole 132 in which the alignment pin 154 is disposed to bias the alignment pin 154 toward the second end portion 128 of the plug 104. One shoulder 162 of the alignment pin 154 is engaged by the spring 164, and the other shoulder 162 is engaged with an end wall 166 of the end cap 140. End wall 166 extends around and defines a notch 158 and an end wall opening 156. Notch 158 is in communication with and extends radially outwardly from opening 156. The alignment pin 154 projects into notch 158 and engages end wall 166 of the end cap 140 to secure the end cap 140 to the plug 104 by preventing end cap 140 from sliding laterally transversely to longitudinal axis 103 relative to plug 104. Alignment pin 154 also aligns the plug 104, the end cap 140, and the tail piece 142 in a predetermined orientation relative to each other. The alignment pin 154 also assisting in the transfer of rotation of the plug 104 to the tail piece 142 so that the door can be locked and unlocked.

As further shown in FIGS. 3-6, the end cap 140 also includes a plug engagement mechanism 168 extending inwardly from an end of cylindrical wall 144 that is opposite of the end wall 166. Plug engagement mechanism 168 is configured to engage end cap receiving portion 170 at second end portion 128 of plug 104. In one embodiment, end cap receiving portion 170 includes opposite undercuts 172 (only one shown in FIG. 5) in each of the opposite linear wall segments 174*a*, 174*b* of end portion 128. In the illustrated embodiment, plug engagement mechanism 168 includes first and second projecting members 176*a*, 176*b* extending inwardly from the end of cylindrical wall 144 that is opposite end wall 166. Projecting members 176*a*, 176*b* define respective ones of lips or support ledges 178*a*, 178*b* that face and parallel the end wall 166. Projecting members 176*a*, 176*b* are received in respective ones of the undercuts 172 of end cap receiving portion 170 in cooperative engagement with plug 104 so that support ledges 178*a*, 178*b* contact and provide an intimate fit with an adjacent facing surface along undercuts 172 defined by end cap receiving portion 170.

End cap receiving portion 170 includes opposite linear wall segments 174*a*, 174 that are connected by opposite arcuate wall segments 180*a*, 180*b*. The linear wall segments 174*a*, 174*b* along undercuts 172 form flats that define a keyed relationship with end cap 140 to ensure end cap 140 is fitted on plug 104 in the proper orientation and to resist rotation of end cap 140 relative to plug 104. Linear wall segments 174*a*, 174*b* can also apply torque to end cap 140 for rotation of the tail piece 142 extending from end cap 140. The inner surface of cylindrical wall 144 corresponds to the curvature of the adjacent arcuate wall segment 180*b* while wall segment 180*a* resides in lateral opening 146 of end cap 140. Alignment pin 154 is depressed while plug engagement mechanism 168 of end cap 140 is interfitted with end cap receiving portion 170 at second end portion 128 of plug 104 from a lateral direction transverse to longitudinal axis 103. When end cap 140 is fitted on second end portion 128 in a proper final position, alignment pin 154 is released to spring outwardly from plug 104 and into contact with end wall 166 in notch 158. Alignment pin 154 laterally secures end cap 140 to second end portion 128. The end cap 140 can be removed by depressing alignment pin 154 to allow end cap 140 to slide laterally relative to plug 104.

Figure 6:
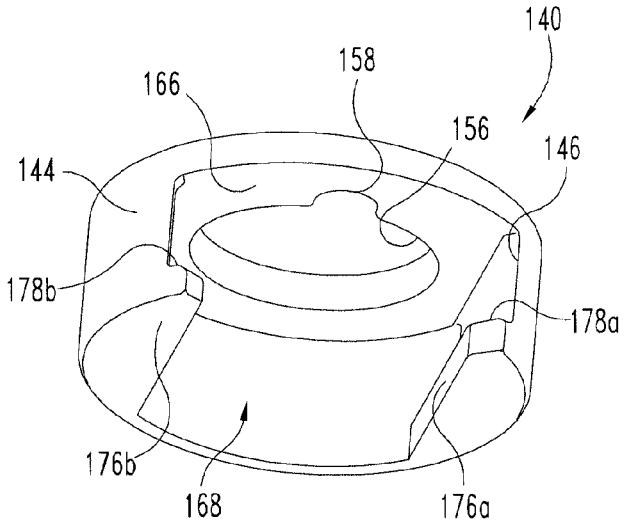
FIG. 6 is a perspective view of the end cap of FIGS. 1-5.
Figure 7:
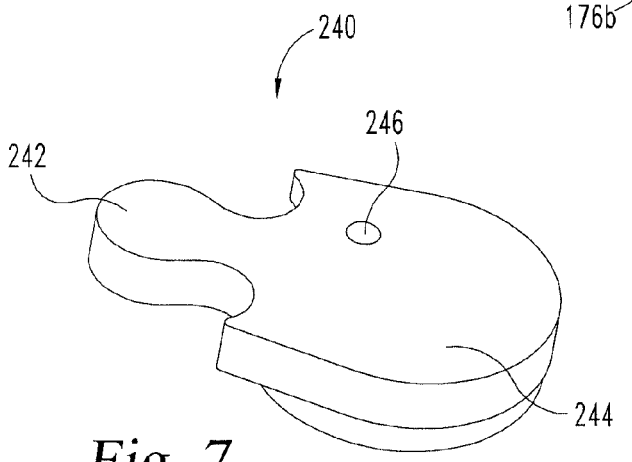
FIG. 7 is a perspective view of another embodiment end cap attachable to the lock assembly of FIG. 1.

FIGS. 6-7 show another embodiment of the end cap 140, designated as end cap 240. End cap 240 engages second end portion 128 of plug 104 in a manner similar to end cap 140 discussed above. End cap 240 is configured for use in a mortise lock assembly that is lockable and unlockable using an appropriate key 10 with lock assembly 100. Generally, the end cap 240 cooperates with a mortise chassis (not shown) that is disposed in the door to lock and unlock the door.

End cap 240 includes a cam 242 projecting outwardly from a cam body 244. In one embodiment, cam 242 is in the form of a lobe, although other configurations are possible. End cap 240 and cam 242 are rotatable with the plug 104 to transfer rotation from the plug 104 to the mortise chassis. End cap 240 further includes a hole 246 through body 244 that receives alignment pin 154 when end cap 240 is finally positioned on end portion 128 of plug 104.

Figure 8:
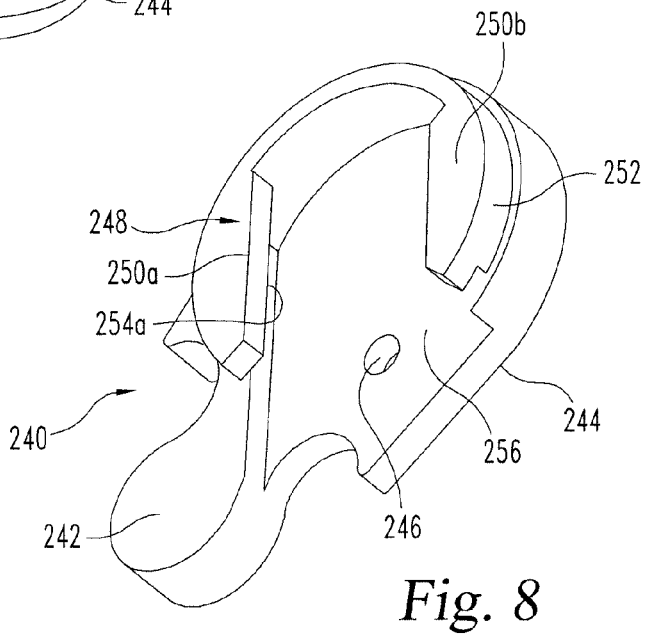
FIG. 8 is another perspective view of the end cap of FIG. 7.

As shown in FIG. 8, end cap 240 also includes a plug engagement mechanism 248 that is spaced from and connected to cam body 244. Plug engagement mechanism 248 is configured to engage end cap receiving portion 170 at second end portion 128 of plug 104 in a manner similar to that described above for end cap 140. In the illustrated embodiment, plug engagement mechanism 248 includes first and second projecting members 250*a*, 250*b* extending inwardly from the end of a cylindrical wall 252 that projects from an end wall formed by cam body 244. Projecting members 250*a*, 250*b* are opposite the end wall of cam body 244 and define respective ones of lips or support ledges 254*a* (only one shown) that face the end wall of cam body 244. Projecting members 250*a*, 250*b* are received in respective ones of the undercuts 172 of end cap receiving portion 170 in cooperative engagement so that support ledges 254*a*, 254*b* contact and provide and intimate fits with an adjacent facing surface of end portion 128 defined by undercuts 172.

Cylindrical wall 252 forms an inner surface that corresponds to the adjacent curvature of arcuate wall segment 180*b* while wall segment 180*a* resides in a lateral opening 256 of wall 252. Lateral opening 256 defines a space between projecting members 250*a*, 250*b*. The linear wall segments 174*a*, 174*b* of end cap receiving portion 170 provide keyed flats that ensure end cap 240 is fitted on plug 104 in the proper orientation and resist rotation of end cap 240 relative to plug 104. Linear wall segments 174*a*, 174*b* can also assisting in applying torque for rotation of cam 242 extending from end cap 240. Alignment pin 154 is depressed while end cap 240 is laterally fitted with end cap receiving portion 170 at second end portion 128 of plug 104. When end cap 240 is properly fitted on second end portion 128, alignment pin 154 can be released to spring outwardly from plug 104 and into contact with the end wall of body 244 via hole 246. The end cap 240 can be removed by depressing alignment pin 154 to allow end cap 240 to slide laterally relative to plug 104.

The end caps 140, 240 are universal among the different lock assemblies. In other words, the end caps 140, 240 are not specific to a particular lock type design and can be used to secure any tail piece or cam member to the plug.

According to another aspect, a lock assembly is provided. The lock assembly includes an elongated housing that extends along a longitudinal axis between a first end and an opposite second end. The elongated housing defines a hollow portion between the first and second ends. The assembly also includes a plug positioned in the hollow portion of the housing. The plug includes an elongate body extending between a first end portion and an opposite second end portion. The body of the plug defines a key slot in the first end portion for receiving a key to rotate the plug relative to the housing. A latch operating mechanism extends from the second end portion of the plug. The lock assembly also includes an end cap configured to couple the operating mechanism to the second end portion of the plug so that rotation of the plug rotates the operating mechanism. The second end portion of the plug is configured to slidably receive the end cap in a keyed orientation from a direction transverse to the longitudinal axis for securement to one another in an interfitted relationship. The interfitted relationship prevents the end cap from moving along and around the longitudinal axis relative to the plug.

According to another aspect, a lock assembly is provided. The lock assembly includes an elongated housing extending along a longitudinal axis between a first end and an opposite second end and a hollow portion is defined between the first and second ends. The assembly includes a plug positioned in the hollow portion of the housing. The plug includes an elongate body extending between a first end portion and an opposite second end portion. The body of the plug defines a key slot in the first end portion for receiving a key to rotate the plug relative to the housing. The plug further defines opposite undercuts in the second end portion that extend transversely to the longitudinal axis. An operating mechanism extends from the second end portion of the plug. The lock assembly also includes an end cap configured to couple the operating mechanism to the second end portion of the plug so that rotation of the plug rotates the operating mechanism. The end cap includes an end wall from which the operating mechanism extends. The end cap further includes a cylindrical wall extending from the end wall and a plug engagement mechanism extending from the cylindrical wall opposite the end wall. The plug engagement mechanism includes opposite projecting members extending from the cylindrical wall that are received in respective ones of the opposite undercuts to axially secure the end cap to the plug.

According to one embodiment, the lock assembly includes an alignment pin housed in the plug. The alignment pin is axially biased into engagement with the end cap in the interfitted relationship with the plug to prevent the end cap from moving transversely to the longitudinal axis relative to the plug. In one refinement, the end cap includes an end wall that defines a hole and the alignment pin is removably engaged to the end cap in the hole. In yet another refinement, the end cap includes an end wall that defines an opening through which the latch operating mechanism extends and a notch along the opening. The alignment pin is removably engaged to the end cap in the notch.

In another embodiment, the end cap includes an end wall, a cylindrical wall extending from the end wall toward the plug, and a plug engagement mechanism extending from the cylindrical wall opposite the end wall. In one refinement, the cylindrical wall defines a lateral opening into the plug engagement mechanism. In a further refinement, the plug engagement mechanism includes a first projecting member and an opposite second projecting member that extend into a space defined by the cylindrical wall. The first and second projecting members are slidably received in undercuts defined by the second end portion of the plug. In yet a further refinement, the first and second projecting members each define a ledge facing the end wall that contact the second end portion of the plug along the undercuts. In another refinement, the second end portion of the plug further defines opposite first and second linear wall segments along respective ones of opposite first and second undercuts. The linear wall segments define the keyed orientation of the end cap relative to the plug. In one refinement, the second end portion of the plug includes opposite arcuate wall segments connecting the first and second linear wall segments to one another.

In one embodiment, the end cap is keyed to the second end portion of the plug so that the end cap can only be engaged to the plug in a predetermined orientation. In one refinement, the keyed engagement of the second end portion of the plug to the end cap prevents the end cap from rotating relative to the plug around the longitudinal axis.

In another embodiment, the assembly includes an alignment pin housed in the plug that is axially biased into engagement with the end cap to prevent the end cap from moving relative to the plug transversely to the longitudinal axis. The end wall of the end cap defines a hole and the alignment pin is removably engaged to the end cap in the hole. In yet another embodiment, the d end cap includes an end wall that defines an opening and a notch along the opening, and the alignment pin is removably engaged to the end cap in the notch.

In a further embodiment, the cylindrical wall defines a lateral opening into the plug engagement mechanism through which the second end portion of the plug is received when the end cap is fitted to the plug. In another embodiment, the operating mechanism includes one of a tail piece with an elongated bar extending from the end cap along the longitudinal axis and a lobe extending outward from the end cap transversely to the longitudinal axis.

According to a further aspect, a method for assembling a lock is disclosed. The method includes positioning an elongated plug in an elongated housing so that a first end of the plug defining a key slot for receiving a key is generally aligned with a first end of the housing and a second end portion of the plug opposite the first end projects outwardly from a second end of the housing; depressing an alignment pin into the plug against a biasing member; sliding an end cap transversely to the longitudinal axis to secure the end cap in an interfitted relationship with the second end portion of the plug to prevent the end cap from rotating relative to the plug and from moving axially relative to the plug; and releasing the alignment pin to engage the end cap with the alignment pin, wherein the end cap couples a latch operating mechanism to the plug so that rotation of the plug relative to the housing rotates the latch operating mechanism.

In one embodiment of the method, the interfitted relationship is defined by undercuts in the second end portion of the plug that slidably receive projecting members of the end cap that extend into an interior space of the end cap.

While the invention has been illustrated and described in detail in the drawings and foregoing description, the same is to be considered as illustrative and not restrictive in character, it being understood that only the certain embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock assembly, comprising:

an elongated housing extending along a longitudinal axis between a first end and an opposite second end, said elongated housing defining a hollow portion between said first and second ends;

a plug positioned in said hollow portion of said housing, said plug including an elongate body extending between a first end portion and an opposite second end portion, wherein said body defines a key slot in said first end portion for receiving a key to rotate said plug relative to said housing;

a latch operating mechanism extending from said second end portion of said plug;

an end cap configured to couple said operating mechanism to said second end portion of said plug so that rotation of said plug rotates said operating mechanism, wherein said second end portion of said plug is configured to slidably receive said end cap in a keyed orientation from a direction transverse to said longitudinal axis for securement to one another in an interfitted relationship, wherein said interfitted relationship prevents said end cap from moving along and around said longitudinal axis relative to said plug; and an alignment pin housed in said plug, wherein said alignment pin selectively prevents movement of said end cap in said direction transverse to said longitudinal axis; and wherein said alignment pin is removably engaged with said end cap.

2. The lock assembly of claim 1, wherein said end cap includes an end wall that defines a hole and said alignment pin is removably engaged to said end cap in said hole.

3. The lock assembly of claim 1, wherein said end cap includes an end wall that defines an opening through which said latch operating mechanism extends and a notch along said opening, and said alignment pin is positioned in said notch.

4. The lock assembly of claim 1, wherein said end cap includes an end wall, a cylindrical wall extending from said end wall toward said plug, and a plug engagement mechanism extending from said cylindrical wall opposite said end wall.

5. The lock assembly of claim 4, wherein said cylindrical wall defines a lateral opening into said plug engagement mechanism.

6. The lock assembly of claim 5, wherein said plug engagement mechanism includes a first projecting member and an opposite second projecting member that extend into a space defined by said cylindrical wall, said first and second projecting members being slidably received in undercuts defined by said second end portion of said plug.

7. The lock assembly of claim 6, wherein said first and second projecting members each define a ledge facing said end wall that contact said second end portion of said plug along said undercuts.

8. The lock assembly of claim 6, wherein said second end portion of said plug further defines opposite first and second linear wall segments along respective ones of opposite first and second undercuts, said linear wall segments defining said keyed orientation of said end cap relative to said plug.

9. The lock assembly of claim 8, wherein said second end portion of said plug includes opposite arcuate wall segments connecting said first and second linear wall segments to one another.

10. The lock assembly of claim 1, wherein said operating mechanism includes one of a tail piece with an elongated bar extending from said end cap along said longitudinal axis and a lobe extending outward from said end cap transversely to said longitudinal axis.

11. A lock assembly, comprising:

an elongated housing extending along a longitudinal axis between a first end and an opposite second end, said elongated housing defining a hollow portion between said first and second ends;

a plug positioned in said hollow portion of said housing, said plug including an elongate body extending between a first end portion and an opposite second end portion, wherein said body defines a key slot in said first end portion for receiving a key to rotate said plug relative to said housing;

a latch operating mechanism extending from said second end portion of said plug;

an end cap configured to couple said operating mechanism to said second end portion of said plug so that rotation of said plug rotates said operating mechanism, wherein said second end portion of said plug is configured to slidably receive said end cap in a keyed orientation from a direction transverse to said longitudinal axis for securement to one another in an interfitted relationship, wherein said interfitted relationship prevents said end cap from moving along and around said longitudinal axis relative to said plug; and an alignment pin housed in said plug, wherein said alignment pin is axially biased into engagement with said end cap in said interfitted relationship with said plug to prevent said end cap from moving transversely to said longitudinal axis relative to said plug, and wherein with said end cap in said interfitted relationship with said plug and said alignment pin in a depressed position, said end cap is not prevented from moving transversely to said longitudinal axis relative to said plug.

12. A lock assembly, comprising:

an elongated housing extending along a longitudinal axis between a first end and an opposite second end, said elongated housing defining a hollow portion between said first and second ends;

a plug positioned in said hollow portion of said housing, said plug including an elongate body extending between a first end portion and an opposite second end portion, wherein said body defines a key slot in said first end portion for receiving a key to rotate said plug relative to said housing, wherein said plug further defines opposite undercuts in said second end portion that extend transversely to said longitudinal axis;

an operating mechanism extending from said second end portion of said plug;

an end cap configured to couple said operating mechanism to said second end portion of said plug so that rotation of said plug rotates said operating mechanism, wherein said end cap includes an end wall from which said operating mechanism extends, said end cap further including a cylindrical wall extending from said end wall and a plug engagement mechanism extending from said cylindrical wall opposite said end wall, wherein said plug engagement mechanism includes opposite projecting members extending from said cylindrical wall that are received in respective ones of said opposite undercuts to axially secure said end cap to said plug; and an alignment pin housed in said plug that is axially biased into engagement with said end cap to prevent said end cap from moving relative to said plug in a transverse direction extending transversely to said longitudinal axis;

wherein said end wall of said end cap defines a recess, said alignment pin is removably engaged to said end cap in said recess, and wherein when said alignment pin is disengaged from said recess, said end cap is movable relative to said plug in said transverse direction.

13. The lock assembly of claim 12, wherein said end cap is keyed to said second end portion of said plug so that said end cap can only be engaged to said plug in a predetermined orientation.

14. The lock assembly of claim 13, wherein said keyed engagement of said second end portion of said plug to said end cap prevents said end cap from rotating relative to said plug around said longitudinal axis.

15. The lock assembly of claim 12, wherein said recess comprises a hole and said alignment pin is removably engaged to said end cap in said hole, and wherein when said alignment pin is disengaged from said hole, said end cap is movable relative to said plug in said transverse direction.

16. The lock assembly of claim 12, wherein said end wall defines an opening and said recess comprises a notch formed along said opening, and said alignment pin is removably engaged to said end cap in said notch.

17. The lock assembly of claim 12, wherein said cylindrical wall defines a lateral opening into said plug engagement mechanism through which said second end portion of said plug is received when said end cap is fitted to said plug.

18. The lock assembly of claim 12, wherein said operating mechanism includes one of a tail piece with an elongated bar extending from said end cap along said longitudinal axis and a lobe extending outward from said end cap transversely to said longitudinal axis.

19. A method for assembling a lock, comprising:

positioning an elongated plug in an elongated housing so that a first end of the plug defining a key slot for receiving a key is generally aligned with a first end of the housing and a second end portion of the plug opposite the first end projects outwardly from a second end of the housing;

depressing an alignment pin into the plug against a biasing member;

sliding an end cap transversely to the longitudinal axis in a first direction to secure the end cap in an interfitted relationship with the second end portion of the plug, wherein the interfitted relationship prevents the end cap from rotating relative to the plug and from moving axially relative to the plug; and releasing the alignment pin to engage the end cap with the alignment pin, wherein with the end cap engaged with the alignment pin, the alignment pin prevents movement of the end cap in a second direction opposite the first direction;

wherein the end cap couples a latch operating mechanism to the plug so that rotation of the plug relative to the housing rotates the latch operating mechanism.

20. The method of claim 19, wherein the interfitted relationship is defined by undercuts in the second end portion of the plug that slidably receive projecting members of the end cap that extend into an interior space of the end cap.

* * * * *